US008827796B2

(12) United States Patent
Vermaak et al.

(10) Patent No.: US 8,827,796 B2
(45) Date of Patent: Sep. 9, 2014

(54) DISPLAY OF SYMBOL ACCUMULATION IN REEL-TYPE GAMES

(75) Inventors: Richard Vermaak, Durban (ZA); Theo Naicker, Durban (ZA); Brendan Clyde Walton, Chaka's Rock (ZA); Terence Igesund, Durban (ZA)

(73) Assignee: Cork Group Trading Ltd., Road Town, Tortola (VG)

( * ) Notice: Subject to any disclaimer, the term of this patent is extended or adjusted under 35 U.S.C. 154(b) by 0 days.

(21) Appl. No.: 13/353,519

(22) Filed: Jan. 19, 2012

(65) Prior Publication Data

US 2013/0184045 A1 Jul. 18, 2013

(30) Foreign Application Priority Data

Jan. 16, 2012 (GB) ..... 1200662.3

(51) Int. Cl.
*A63F 9/24* (2006.01)

(52) U.S. Cl.
USPC ..... 463/20; 463/42

(58) Field of Classification Search
USPC ..... 463/20
See application file for complete search history.

(56) References Cited

U.S. PATENT DOCUMENTS

| | | | | |
|---|---|---|---|---|
| 4,836,553 | A | 6/1989 | Suttle et al. | 273/292 |
| 4,948,134 | A | 8/1990 | Suttle et al. | 463/13 |
| 5,374,067 | A | 12/1994 | Jones | 273/292 |
| 5,764,518 | A | 6/1998 | Collins | |
| 5,848,932 | A | 12/1998 | Adams | 463/20 |
| 6,089,977 | A | 7/2000 | Bennett | |
| 6,117,013 | A | 9/2000 | Eiba | |
| 6,336,863 | B1 | 1/2002 | Baerlocher et al. | 463/27 |
| 6,364,313 | B1 | 4/2002 | Moody | 273/138.1 |
| 6,398,218 | B1 | 6/2002 | Vancura | 463/20 |
| 6,413,162 | B1 | 7/2002 | Baerlocher et al. | |
| 6,419,578 | B1 | 7/2002 | Moody et al. | 463/13 |
| 6,485,368 | B2 | 11/2002 | Jones et al. | 463/13 |
| 6,551,187 | B1 | 4/2003 | Jaffe | |
| 6,565,434 | B1 | 5/2003 | Acres | 463/25 |
| 6,676,512 | B2 | 1/2004 | Fong et al. | |
| 6,752,395 | B2 | 6/2004 | Jones et al. | 273/292 |
| 6,786,818 | B1 | 9/2004 | Rothschild et al. | |

(Continued)

FOREIGN PATENT DOCUMENTS

| | | | |
|---|---|---|---|
| AU | 781843 | B2 | 6/2005 |
| AU | 2009251197 | A1 | 7/2011 |

(Continued)

OTHER PUBLICATIONS

"Trouble" game document by Milton Bradley/Hasbro, copyrighted 2002.

(Continued)

*Primary Examiner* — Steve Rowland
(74) *Attorney, Agent, or Firm* — McDonnell Boehnen Hulbert & Berghoff LLP

(57) ABSTRACT

Machines, servers and reel-type games are disclosed which provide a player with a visible indication of progress being made towards award of a stacked or expanding symbol on a reel, thereby heightening anticipation and increasing excitement of the game. A trigger condition for appearance of the stacked or expanding symbol can be achieved (i.e. accumulated or collected) over multiple turns or spins of the game. Progress towards meeting the trigger condition is displayed to the player directly on the display of the game.

30 Claims, 4 Drawing Sheets

(56) References Cited

U.S. PATENT DOCUMENTS

| | | | | |
|---|---|---|---|---|
| 6,800,030 | B2 | 10/2004 | Acres | 463/25 |
| 6,811,486 | B1 | 11/2004 | Luciano, Jr. | |
| 6,910,964 | B2 | 6/2005 | Acres | 463/25 |
| RE38,812 | E | 10/2005 | Acres et al. | 463/26 |
| 6,955,600 | B2 | 10/2005 | Glavich | 463/20 |
| 6,988,947 | B2 | 1/2006 | Baerlocher et al. | 463/20 |
| 7,144,322 | B2 | 12/2006 | Gomez et al. | |
| 7,204,754 | B2 | 4/2007 | Gray et al. | 463/16 |
| 7,371,170 | B2 | 5/2008 | Cregan et al. | |
| 7,473,173 | B2 | 1/2009 | Peterson et al. | |
| 7,494,413 | B2 | 2/2009 | Singer et al. | 463/20 |
| 7,503,848 | B2 | 3/2009 | Berman et al. | 463/18 |
| 7,578,735 | B2 | 8/2009 | Frizzell et al. | |
| 7,578,738 | B2 | 8/2009 | Cregan et al. | |
| 7,591,724 | B2 | 9/2009 | Baerlocher | |
| 7,597,618 | B2 | 10/2009 | Webb et al. | 463/16 |
| 7,601,062 | B2 | 10/2009 | Cole et al. | |
| 7,674,180 | B2 | 3/2010 | Graham et al. | |
| 7,677,968 | B2 | 3/2010 | Schultz et al. | |
| 7,690,983 | B2 | 4/2010 | Hartl et al. | 463/20 |
| 7,753,769 | B2 | 7/2010 | Gomez et al. | |
| 7,758,414 | B1 * | 7/2010 | Marks et al. | 463/20 |
| 7,794,317 | B2 | 9/2010 | Kaminkow et al. | 463/16 |
| 7,819,737 | B2 | 10/2010 | Englman et al. | |
| 7,824,262 | B2 | 11/2010 | Webb et al. | 463/17 |
| 7,867,079 | B2 | 1/2011 | Govender | 463/25 |
| 7,976,376 | B2 | 7/2011 | Kroeckel et al. | 463/20 |
| 7,993,199 | B2 | 8/2011 | Iddings et al. | |
| 8,012,009 | B2 | 9/2011 | Iddings et al. | |
| 8,087,995 | B2 | 1/2012 | Englman et al. | |
| 8,088,001 | B2 | 1/2012 | Preisach | |
| 2003/0022712 | A1 | 1/2003 | Locke | |
| 2003/0087690 | A1 | 5/2003 | Loose et al. | |
| 2003/0190947 | A1 | 10/2003 | Baerlocher et al. | |
| 2004/0023714 | A1 | 2/2004 | Asdale | |
| 2004/0048650 | A1 | 3/2004 | Mierau et al. | |
| 2004/0132527 | A1 | 7/2004 | Berman et al. | |
| 2004/0166923 | A1 | 8/2004 | Michaelson et al. | |
| 2004/0198486 | A1 | 10/2004 | Walker et al. | |
| 2005/0054420 | A1 | 3/2005 | Cregan et al. | |
| 2005/0054436 | A1 | 3/2005 | Frizzell et al. | |
| 2005/0059474 | A1 | 3/2005 | O'Halloran | |
| 2005/0070353 | A1 | 3/2005 | Webb et al. | |
| 2005/0075163 | A1 | 4/2005 | Cuddy et al. | |
| 2005/0130732 | A1 | 6/2005 | Rothschild et al. | 463/20 |
| 2005/0192086 | A1 | 9/2005 | Walker et al. | |
| 2006/0046830 | A1 | 3/2006 | Webb | |
| 2006/0068893 | A1 | 3/2006 | Jaffe et al. | |
| 2006/0189377 | A1 | 8/2006 | Gomez et al. | |
| 2007/0060297 | A1 * | 3/2007 | Hein et al. | 463/20 |
| 2007/0060303 | A1 | 3/2007 | Govender et al. | |
| 2007/0213121 | A1 | 9/2007 | Moshal | 463/25 |
| 2008/0064465 | A1 | 3/2008 | Bennett | |
| 2008/0108411 | A1 * | 5/2008 | Jensen et al. | 463/20 |
| 2008/0188280 | A1 * | 8/2008 | Marks et al. | 463/20 |
| 2009/0111566 | A1 | 4/2009 | Naicker et al. | 463/20 |
| 2009/0286588 | A1 * | 11/2009 | Jackson | 463/20 |
| 2010/0016071 | A1 | 1/2010 | Jaffe et al. | 463/27 |
| 2010/0190542 | A1 * | 7/2010 | Mizue | 463/20 |
| 2011/0028202 | A1 | 2/2011 | Naicker et al. | |
| 2011/0223991 | A1 | 9/2011 | Powell et al. | |

FOREIGN PATENT DOCUMENTS

| | | | |
|---|---|---|---|
| EP | 1063622 | A2 | 12/2000 |
| GB | 2097160 | A | 10/1982 |
| WO | WO2006/027677 | | 3/2006 |

OTHER PUBLICATIONS

"CindyJean" by eOpnions.

Cindyjean, Popomatic Trouble—Milton Bradley Trouble—Epinions.com, downloaded from the World Wide Web at http://www.epinions.com/review/Milton_Bradley_Trouble/content_42532310660 on Sep. 2, 2011, pp. 1-4.

U.S. Appl. No. 13/353,756, filed Jan. 19, 2012, 65 pages.

European Patent Office, Extended European Search Report for European Patent Application No. EP 13 15 1139, Apr. 22, 2013, 6 pages.

United Kingdom Intellectual Property Office, Combined Search and Examination Report under Sections 17 and 18(3) for United Kingdom Patent Application GB1200662.3, Jun. 14, 2013, 10 pages.

* cited by examiner

DISPLAY OF SYMBOL ACCUMULATION IN REEL-TYPE GAMES

PRIORITY

This application claims priority benefits under 35 U.S.C. §119 to United Kingdom Patent Application serial no. GB 1200662.3 filed Jan. 16, 2012.

STATEMENT REGARDING FEDERALLY SPONSORED RESEARCH OR DEVELOPMENT

Not applicable.

BACKGROUND

This disclosure relates generally to the field of wager games and more particularly to methods and apparatus that facilitate the use of "stacked" and "expanding" symbols of a reel-type wager game. The methods are applicable in a variety of game playing formats, for example physical slot machines, electronic video gaming terminals, and computer workstations playing wager games over a computer network.

In reel-type games such as slots, one or more reels are provided, each of which contain a multitude of symbols distributed around the circumference of the reel. When a player places a wager (e.g., by placing a coin in the machine) they are then permitted to spin the reels. Each reel comes to rest, typically with either one of the symbols, or a space in between the symbols, in alignment with a pay line. The player wins according to whether a particular winning symbol or combination of symbols is present on the pay line. In a simple three-reel slot machine game, the pay line is the horizontal line going across the middle of the reels. In other reel-type games, such as an array of 3×5 symbols which all change or "spin" during a turn of play, the "pay line" refers to a particular combination of positions of symbols in the 3×5 array which are used to determine if a winning result was achieved; for example, each of the three rows of five symbols could be a different pay line, making three pay lines in total.

The game of slots can be played on a video gaming terminal with a graphical user interface, e.g., a dedicated gaming machine such as found in a casino. In the case of a video gaming terminal, the user interface displays an image of a set of reels. Animation effects are used to simulate the spinning action. A computer software program, which may be resident in the video gaming terminal, randomly generates a result for a simulated spin of the reels, and the result is presented on the user interface.

Slots games are also played over a computer network, e.g., by a player using a personal computer which has established a connection to a gaming server. In this later situation, the gaming server generates results of play and transmits the results over the computer network to the computer for display.

The popularity of video slot games has increased due to the incorporation of a "wild" symbol into such video slot games. A wild symbol, which is usually the highest-ranking symbol of the game, offers line payouts just like any other symbol and, additionally, substitutes for any other symbol in the game, thereby assisting in making winning results and providing a player with entertainment and additional opportunities to win game prizes.

The wild symbol may be associated with additional properties. In particular, the wild symbol may act as a multiplier, i.e. when the wild symbol forms part of a winning result the corresponding payout in the pay table of the game is multiplied by an applicable multiplier. The multiplier is usually fixed and is given in the pay table. The multiplier may also depend on the number of wild symbols forming part of the winning result.

A stacked wild symbol is one that appears as a contiguous stack of wild symbols on a reel (e.g. three wild symbols appearing as if they were successive symbols around the circumference of the reel), which increases still further the potential of having one or more winning results along one of the pay lines.

An expanding wild symbol is one which visually expands (e.g. by computer-driven animation) to occupy the entire reel display area for a given reel, usually depicted by means of an animated sequence. The effect on a payout is the same as that of a stacked wild symbol that occupies the entire reel display area, but the visual effect of the expanding wild symbol animation is different (for example, a single graphical element may expand to cover the whole reel display, rather than the reel display consisting of a plurality of identical wild symbols).

In all of these prior art scenarios, the appearance of a wild symbol (whether single, stacked or expanding) depends on the results of a single play or spin of the underlying video slot game.

Prior art of interest includes Webb US 2005/0070353; Cuddy et al. US 2005/0075163; Jaffe et al. US 2010/0016071; Berman et al US 2004/0132527; Glavich U.S. Pat. No. 6,955,600 and Naicker et al., US 2009/0111566.

SUMMARY

In a first aspect, a machine is disclosed which is configured to enable a player to play a reel-type wager game using the machine. The machine includes a display configured to display two or more reels of a reel-type wager game, a memory storing software instructions for facilitating a user to play the reel-type wager game, and a processor for executing the software instructions. The software instructions include instructions for displaying a result of a spin of such reels in the form of a progress symbol associated with progress towards an award of an expanded or stacked symbol. The progress symbol, which may take the form of a WILD symbol or alternatively one of the other symbols in the symbol set for the reels, causes an activation of an accumulation indicator provided on the display. The accumulation indicator, and preferably a set or cluster of such indicators, provides a display of the progress towards meeting a trigger condition for the award of the expanded or stacked symbol in the respective reel over multiple spins of the reel-type game. The expanded or stacked symbol can also take the form of a WILD symbol.

In another aspect, a gaming server is disclosed communicating with a machine having a display enabling a player to play a reel-type game having two or more reels over a computer network such as the Internet or a local area network, for example in a casino environment. The gaming server includes a processing unit randomly generating results of a spin of each of a plurality of reels in the reel-type game for the machine and transmitting such results to the machine as a datagram over the computer network. The datagram generated by the gaming server includes a data element, e.g., flag or bit, or alternatively data associated with symbols, indicating that one of the results of a spin of such plurality of reels is in the form of a progress symbol associated with progress towards an award of an expanded or stacked symbol. The datagram causes an activation of an accumulation indicator on the machine display providing a display of the progress towards meeting a trigger condition for the award of the expanded or stacked symbol over multiple spins of the reel-type game.

In yet another aspect, a method of playing a reel-type game using a machine having a display is provided. The method includes the steps of providing on the display a plurality of reels, displaying a result of a spin of such reels in the form of a progress symbol associated with progress towards an award of an expanded or stacked symbol, and the progress symbol causing an activation of an accumulation indicator provided on the display providing a display of the progress towards meeting a trigger condition for the award of the expanded or stacked symbol in the respective reel over multiple spins of the reel-type game.

DETAILED DESCRIPTION

Reel-type games are disclosed which provide a player with a visible indication of progress being made towards the appearance of a stacked or expanding symbol on a reel, thereby heightening anticipation and increasing excitement of the game. This is achieved by providing a trigger mechanism for appearance of the stacked or expanding symbol in which the required trigger condition can be achieved (i.e. accumulated or collected) over multiple turns or spins of the video slot game, and by providing a display of the progress towards meeting the trigger condition to the player directly on the display of the game.

The games of this disclosure are typically played on a machine which is configured to play a reel-type wager game featuring a wild symbol. The machine includes a display configured to display two or more reels of a reel-type wager game, a memory storing software instructions for facilitating a user to play the reel-type wager game, and a processor for executing the software instructions. The software features instructions for displaying on the display sets of accumulation indicators associated with each of the two or more reels. An accumulation indicator of a set, which may take the form of an icon or graphical device of any sort, becomes active when the corresponding reel first displays a progress (e.g., wild) symbol during a playing session. The progress symbol may take any form and could for example be the letter "W", the word "Wild", a Bengal Tiger or fanciful symbol, or any other symbol that is associated with the functionality of progress towards the trigger condition. During the playing session the accumulation indicators register each appearance of a progress symbol on the corresponding reel.

Figure 1:
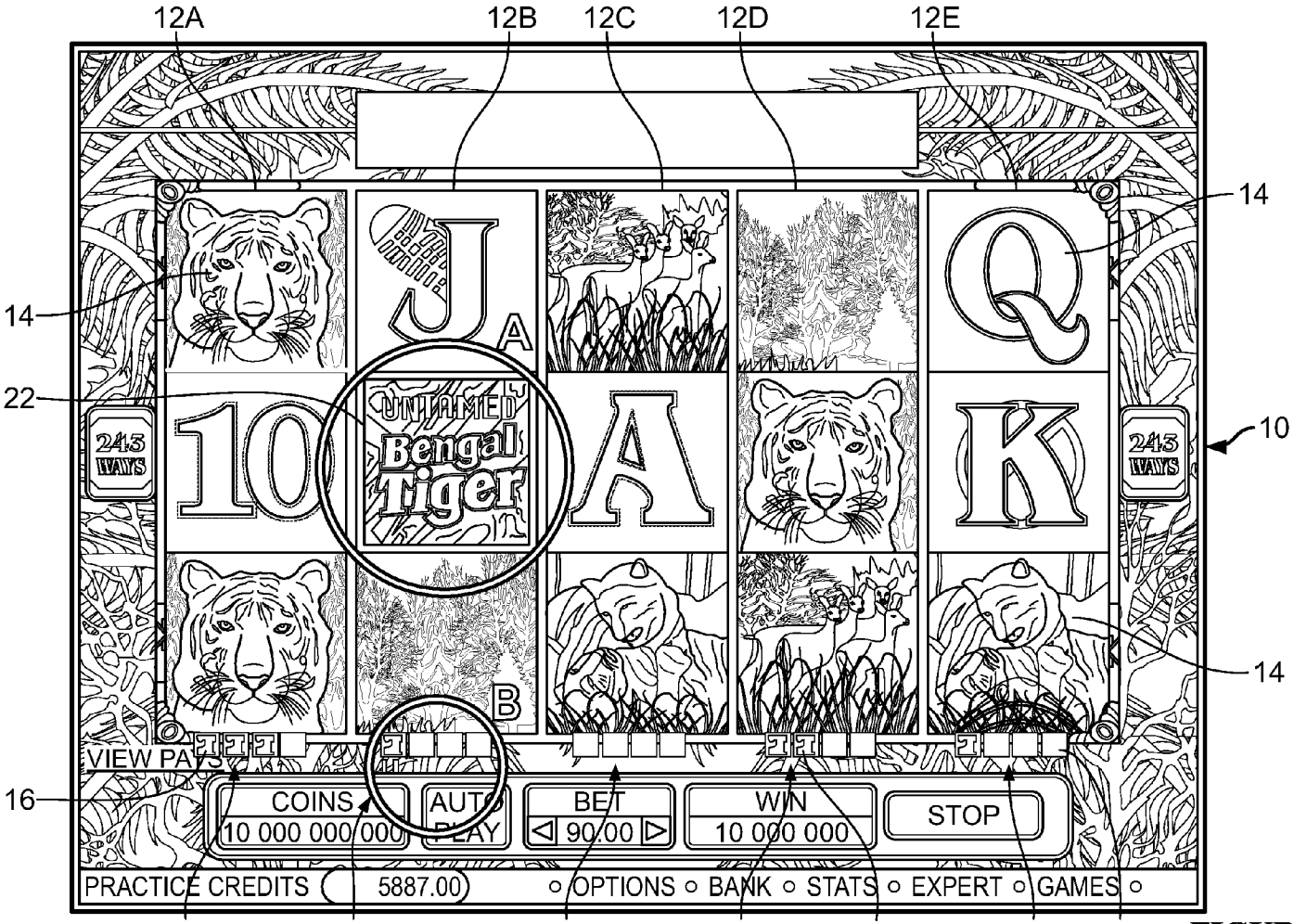
FIG. 1 is an illustration of the display of a machine used to play a reel-type wager game. Each reel has an associated cluster of accumulation indicators which become active progressively when a specific symbol of the symbol set of the game is present in the reel.
Figure 2:
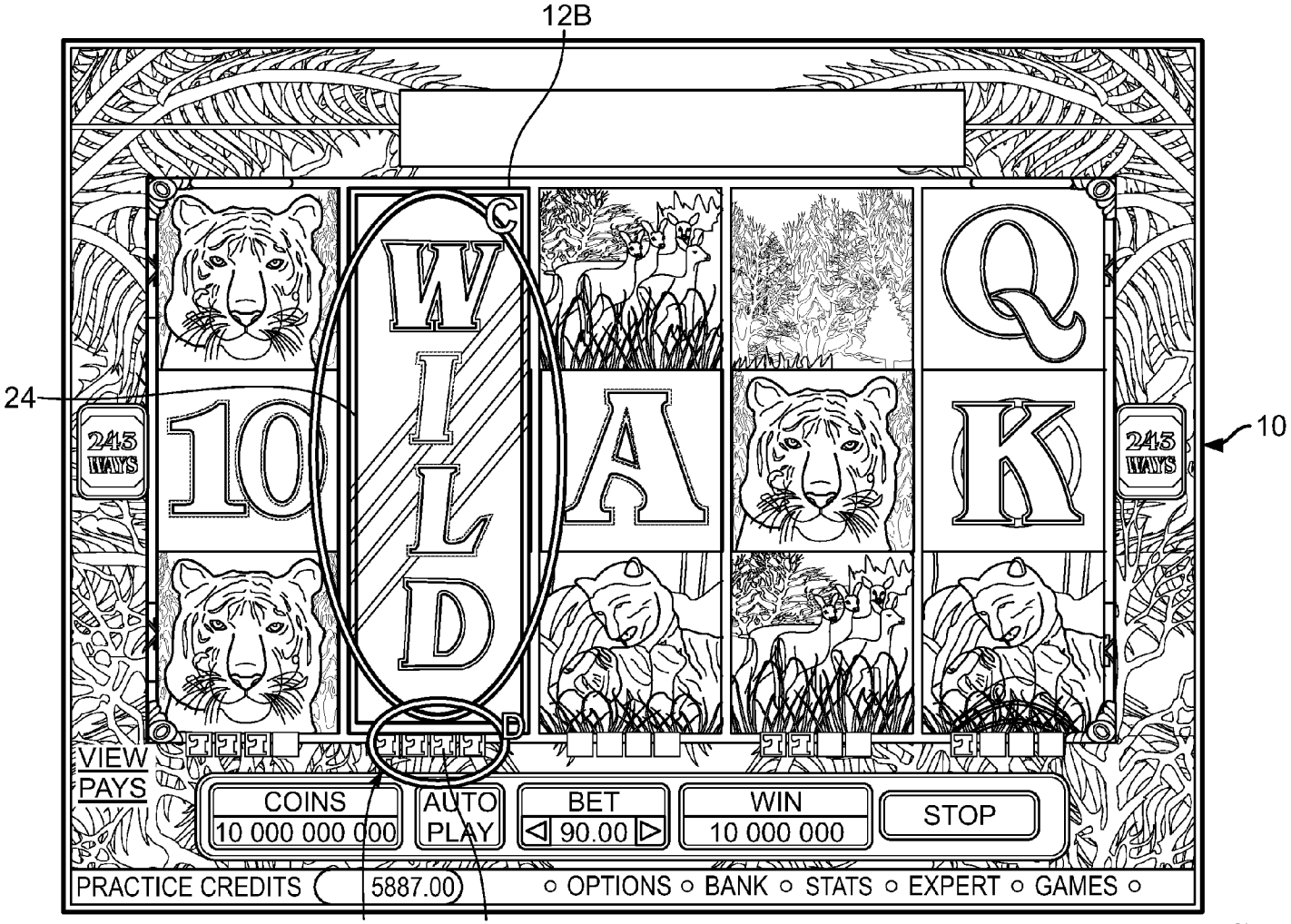
FIG. 2 is an illustration of the display of FIG. 1 after a number of spins of the reels. The clusters of accumulation indicators show that the specific symbol has appeared three times on far left-hand reel, four times on the second reel, twice on the fourth reel and once on the far right-hand reel. The specific symbol has not yet appeared on the centre reel.

This is best illustrated by example with reference to a sequence of screen shots shown in FIGS. 1-2. These screen shots show a display on a user interface (10) of a game playing machine used for playing a reel-type game. The machine may take the form of a video gaming terminal, a slot machine, general purpose computer, personal digital assistant, cellular telephone, or other electronic device. The device includes a memory for storing software instructions (not shown but conventional in such machines) and a processing unit (e.g., CPU or microprocessor) which executes the instructions stored in the machine, which again is conventional. The sequence and organization of the software instructions will be apparent to persons skilled in the art from the description and illustrated examples of operation of the various embodiments of the invention set forth below.

In particular, FIG. 1 is a representation of a five-reel video slot game which is presented on the display (10) of the game playing machine. Symbols (14) are displayed in an array of symbols (14) in M rows and N columns, here M=3 and N=5. Each column is in the form of a reel (12). Each reel (12) displays three symbols after a turn of the game. The game has up to 243 pay lines, each comprising a unique sequence of array elements (14), one from each reel (12), and going from left to right across the display. The pay lines in a game of this type are known in the art and the details are not particularly important. Each of the five reels (12) has an associated cluster (20) or set of four distinct accumulation indicators (16) at the bottom of the slot reel (12). For reasons which will become clear, the shape or nature of the cluster (20) is not particularly important.

The purpose of the accumulation indicators (16) is to indicate the occurrence of progress (e.g., wild) symbols on the various reels of the game. The accumulation indicators (16) of FIG. 1 are shown in different states, as will be fully described in the description that follows. In one possible embodiment they could remain hidden and only appear at the bottom of each reel (12) once a wild symbol has first appeared on the particular reel during a playing session.

The set of symbols (14) of the video slot game contains a "wild" symbol represented in FIG. 1 by the "Untamed Bengal Tiger" symbol (22). During a playing session, whenever a wild symbol (22) appears on a reel (12) for the first time, a first accumulation indicator (16) of the corresponding cluster (20) becomes active. Thus, the "Untamed Bengal Tiger" symbol 22 functions as a "progress symbol" of the instant invention. As game play progresses and further spins of the reels occur, the accumulation indicators (16) of the various clusters (20) that are active remain active. Each subsequent appearance of a wild (progress) symbol (22) on the same reel causes a further accumulation indicator (16) of that cluster to become active. In other words, this phase of the game is structured so that a player's accumulation of wild symbols is preserved from spin to successive spin of the video slot game. The accumulation of wild symbols (22) in this manner on each reel occurs independently of that on the other reels. In FIG. 1 cluster 20A shows that three wild symbols have appeared on reel 12A thus far during the playing session (three accumulation indicators 16 are active). Analogously, one wild symbol has appeared on each of reels 12B and 12E, two wild symbols have appeared on reel 12D and no wild symbols have yet appeared on the centre reel 12C.

In theory, the accumulation of wild symbols could be preserved as long as the player continues to play in one continuous session. It is also possible to "bank" the accumulation should the player quit playing and resume playing later, as will be described in further detail later on.

Turning now to FIG. 2, after further game play, all four accumulation indicators (16) of cluster 20B associated with reel 12B are active, indicating that the player has accumulated a total of four wild symbols at various times during the game play. The appearance of a fourth wild symbol on the reel triggers the appearance of an expanding wild symbol (24), i.e. one that occupies the entire display area of the reel 12B. The exact manner by which the fourth wild symbol to appear on the reel triggers an expanding wild symbol is not important. The aspect to note is that, for the spin in which the fourth wild symbol appeared on reel 12B, the resulting expanding wild symbol (24) means that the entire display area of reel 12B (i.e. a column of 3 symbols in this example) consists of wild symbols, thereby greatly increasing the potential for winning results on the various pay lines of the game.

The expanded wild symbol (24) on reel 12B does not persist beyond the spin of the video slot game in which it was triggered. On each successive spin of the video slot game after the expanding wild symbol was triggered, one of the accumulation indicators (16) of cluster 20B deactivates unconditionally until all four accumulation indicators (16) are inactive, whereupon accumulation of wild symbols can resume, as described above. It is important to observe that activation and deactivation of accumulation indicators (16) corresponding to each reel (20) occurs independently to that on the other reels of the game.

As illustrated in FIGS. 1 and 2, the accumulation of wild symbols (22) in this manner on each reel was displayed to the player—in FIG. 1, there has been no accumulation of wild symbols on reel 12C (none of the accumulation indicators (16) were active), while partial accumulation has occurred on each of the remaining reels. In FIG. 1, the player was ¼ of the way towards the required accumulation threshold on each of reels 12B and 12E (one of four accumulation indicators (16) was active), three-quarters of the way towards the accumulation threshold on reel 12A (three of four accumulation indicators (16) were active) and halfway towards the threshold (2 accumulation indicators (16) were active) on reel 12D. In FIG. 2, on the other hand, the player has made it all the way on reel 12B since all four accumulation indicators (16) have become active.

After the accumulation threshold for any particular reel has been satisfied the last wild symbol to have appeared typically triggers an expanding wild symbol on that reel. Once any resulting winning pay line results have been paid out, the expanding wild symbol (24) on the reel clears and the accumulation indicators (16) associated with the reel become inactive progressively over successive spins of the reels. The player then has to again accumulate the required number of wild symbols on the particular reel as before, and the player's progress towards meeting the accumulation threshold is presented using the accumulation indicators (16) in the manner described above.

In the above embodiment, the essence of the triggering mechanism is that active accumulator indicators (16) are accumulated in any reel over time as game play progresses and the expanding wild symbol is triggered when the total number of active accumulator indicators (16) for the reel meets a threshold, four in this example. It is anticipated that player interest in the video slot game will be sustained, particularly in circumstances where a player has accumulated a substantial proportion of the active accumulation indicators required to trigger an expanding wild symbol on one or more reels.

Clearly, numerous variations and permutations are possible to this embodiment without departing from the scope of the invention. For example:

1. In the above example, accumulation of wild symbols on the different reels (12) of the game occurs independently. In an alternative embodiment, accumulation may only occur sequentially across different reels, either from left to right or from right to left.
2. Instead of requiring activation of all accumulation indicators (16) for a particular reel (12) in order to trigger an expanding wild symbol, it may only be necessary to accumulate a subset of, say, any two accumulation indicators (16) in order to trigger a stack of two wild symbols on that reel.
3. An accumulator indicator (16) may only become active when a wild symbol (22) occurs only on the centre pay line position of the reel instead of occurring on any position in the viewable portion of the associated slot reel.
4. The symbol set of the video slot game may also include a deactivation symbol, e.g., the wild symbol with a line through it. When the deactivation symbol appears on a reel, an active accumulator indicator (16), if any exist at the time, is then deactivated.
5. At the commencement of a playing session, all accumulation indicators (16) are inactive. Alternatively, in order to encourage a player to return to the game, all accumulation indicators that are active at the end of a previous playing session could be carried forward to the player's next playing session. In other words, when a player plays the game and accumulates one or more active accumulation indicators (16), the active indicators are "banked" until the player logs back in and continues playing the game. The "banking" of the active accumulation indicators (16) can take the form of storing data in memory local to the machine indicating the identity of the player and the state of the accumulation indicators (16) at the time of termination of play. Such information may also be stored in a gaming server that functions to generate results of play and transmits results of play to the player's game playing machine.
6. In an alternative embodiment, the accumulation indicators (16) may display the accumulation of any other specific symbol in the symbol set of game instead of the wild symbol as described.
7. Once four active indicators (16) have been accumulated on any particular reel and the expanded wild symbol has been triggered, one of the active accumulation indicators in the cluster (20) deactivates unconditionally on each successive spin of the reels until all four indicators (16) in the cluster have become inactive. Such deactivation occurs irrespectively of whether a wild symbol appears on that reel during the deactivation spins. In an alternative embodiment, the appearance of a wild symbol on the reel during a deactivation spin prevents deactivation of an active accumulation indicator (16). Furthermore, the appearance of two wild symbols on the reel simultaneously during a deactivation spin, not only prevents deactivation of an active indicator, but also activates an inactive indicator (i.e. accumulation of a wild symbol occurs).

Game Playing Environments

As noted previously, the feature of this disclosure of providing notice of progress being made towards the appearance of a stacked or expanding symbol on a reel of a reel-type game can be implemented in a variety of game playing formats. Several representative examples of these formats will be described in this section.

In one format, a personal computer is loaded with game playing software which includes a reel-type game. The game can be played solely for amusement, in which case the computer is typically not interacting with any external resource which logs wagers, determines and communicates results, or adjusts a player's credit account. The game software presents the reels such as shown in FIGS. 1-2 and the accumulation indicators (16). When a "wild"/progress symbol (22) is present on a reel, an associated accumulation indicator (16) for that reel becomes active as described above. The software for the game triggers an expanded wild symbol (24) on the reel when the required number of accumulation indicators (16) become active, e.g., four of them as in the example of FIG. 2.

Figure 3:
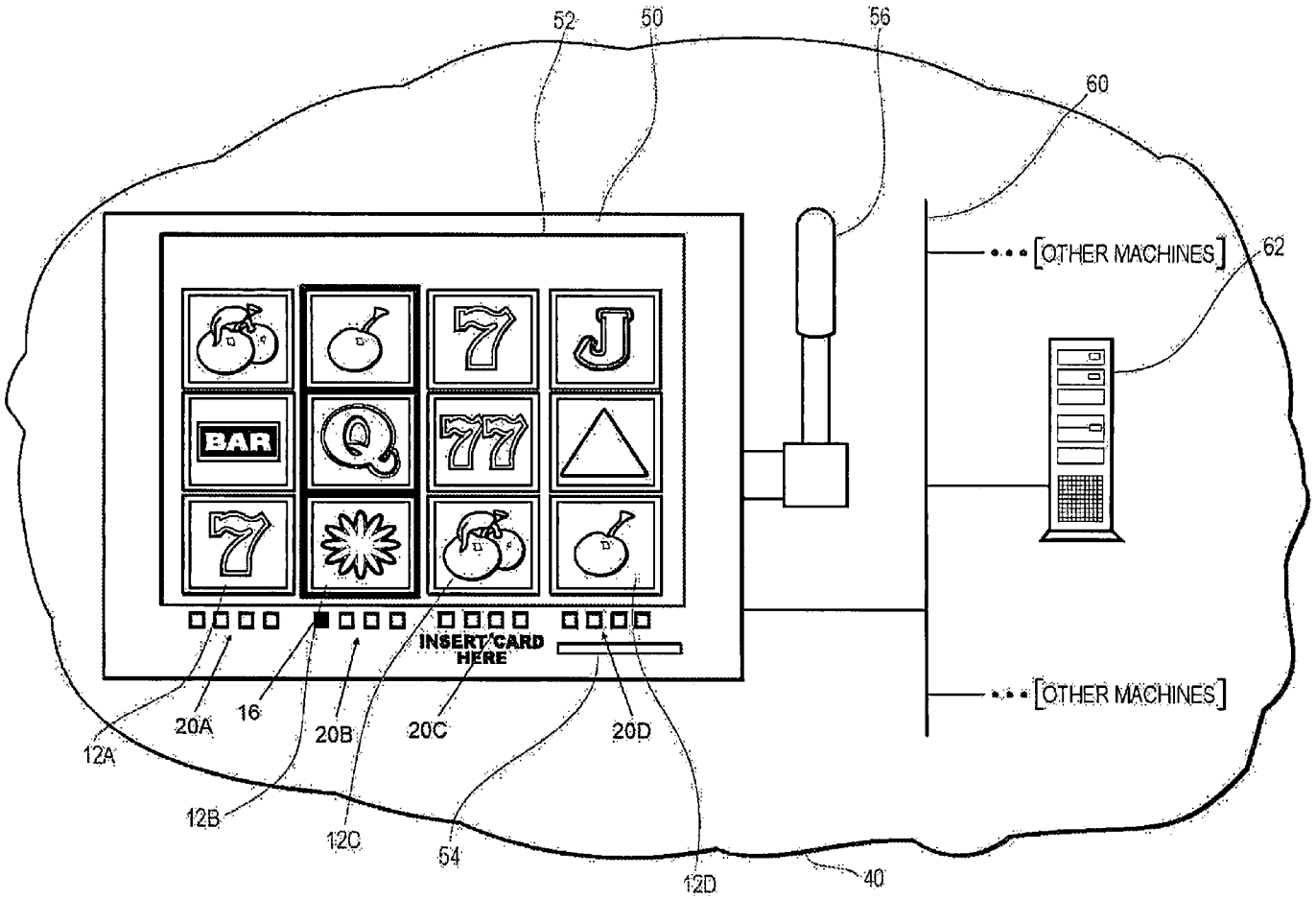
FIG. 3 is an illustration of an environment in which the game shown in FIGS. 1 and 2 can be played by a video gaming terminal in a casino or like establishment. In the embodiment of FIG. 3, the video gaming terminal is shown connected to a server over a local area network.

In another format, the game may be played in a video gaming terminal, such as found in a land or ship-borne casino. One example of this embodiment is shown in FIG. 3. A casino (40) includes a plurality of game playing machines (50) (in this example, four-reel video slot machines) which are connected to a local area network (60). A player inserts a card having a magnetic strip storing a credit amount into a slot (54) in the machine (50). The card is read and wager amounts are deducted from the value carried by the card. The machine (50) includes a display (52) showing four reels (12). The display (52) may also include features which are not shown, such as wager controls, which are conventional and not important. The reels (12) each have an associated cluster or set of accumulation indicators (20A, 20B, 20C and 20D) as described previously. One accumulation indicator (16) of the cluster associated with reel 12B has become active as indicated in FIG. 3 due to the wild symbol (22)—a star symbol in this example, being present in the bottom position of the reel. A turn of the game is made by pulling on the handle (56) or by pressing a spin button, or in some other fashion.

In this example, the results of play are generated by a gaming server (62) using a random number generator (or other process to generate a set of reel symbols randomly). The gaming server communicates the results of play to the video gaming terminal (50) over the network (60) as a packet or datagram containing data indicating which symbols are to be displayed on the reels (12). The datagram is processed by software resident on the video gaming terminal (50) and presented on the display (52) in known fashion. When the server's randomly generated results include the wild symbol (22), the server includes with the datagram containing the results of the spin a flag or bit which indicates that an accumulation indicator (16) of the cluster associated with the reel in question is to become active, since one of the resulting symbols for reel (12B) is the star symbol (22). Alternatively, the software resident in the terminal (50) may include logic or code which searches the datagram for data indicating that the star symbol was returned as a result, and if it finds such data an accumulation indicator (16) of the cluster for the associated reel (12B) is activated.

In this example, suppose the player accumulated a single active accumulation indicator (16) on reel 12B and then decided to play poker at a table in the casino (40), or some other wager game on a different machine (50). The player's accumulation of active accumulation indicators (16) is stored in the gaming server (62) or, alternatively, locally on the player's magnetic card. The player ejects their card from the slot (54) and then proceeds to play wager games elsewhere in the casino. At a later time, they may return to a machine (50) (which need not be the same machine they previously played at) and insert their card. The card includes a unique code such as a card number which is correlated at the server (62) with the stored results when the player previously exited the game. The display of the reels reverts to the display of the accumulated active accumulation indicators (16) that was present when the player previously exited the game on the previous machine (50). In this example, the single accumulation indicator (16) associated with cluster (20B) corresponding to reel 12B is active and the player continues accumulating wild symbols where they left off. In one variation, the accumulation of active accumulation indicators (16) is not carried over and when they exit the play on the machine (50) any accumulated active accumulation indicators (16) are lost.

Aspects for this invention are also particularly suited for use in the context of playing of wager games over a computer network, including a local area network for example in a physical casino environment or over a wide area network, such as the Internet.

Figure 4:
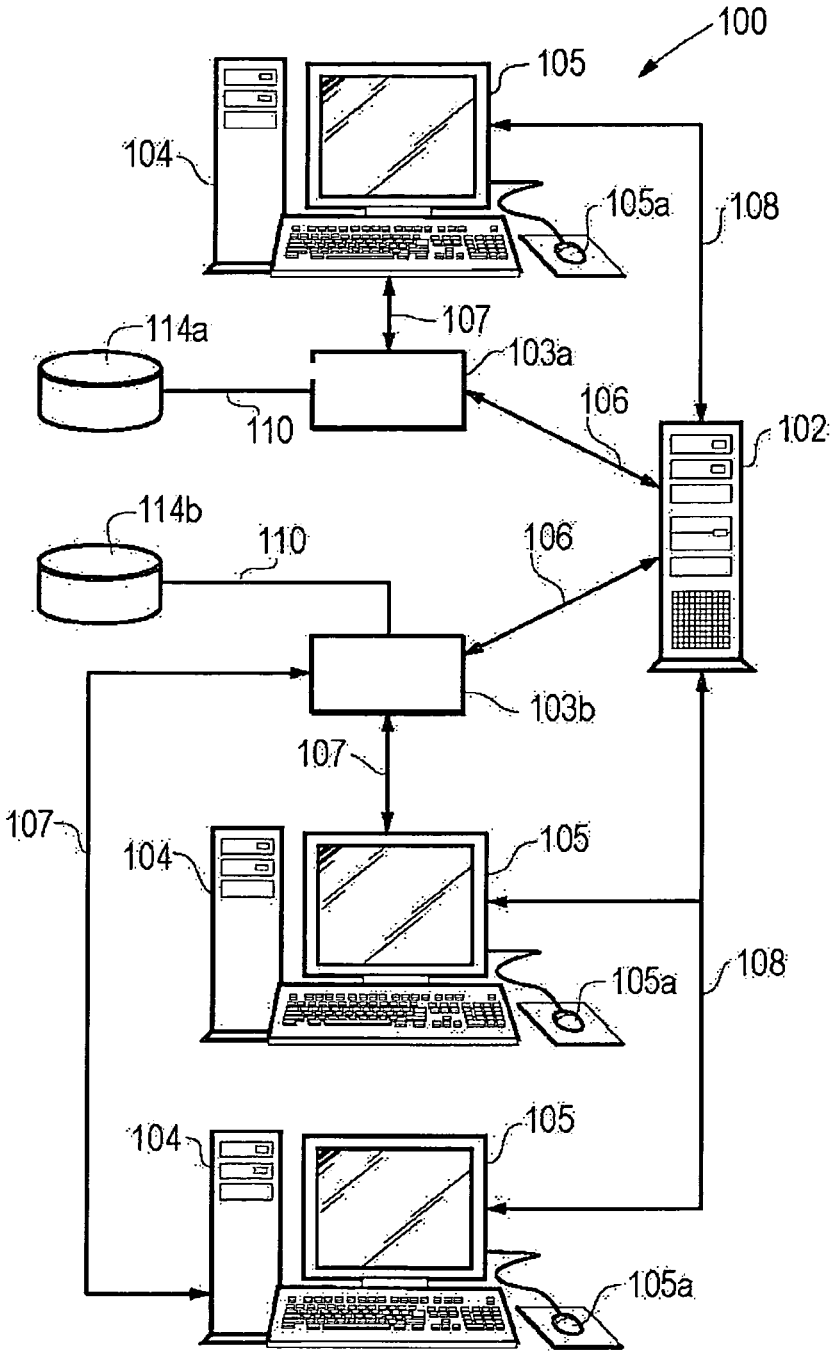
FIG. 4 is an is an illustration of an environment in which the game shown in FIGS. 1 and 2 can be played by computer workstations connected to a server over a wide area network such as the Internet.

Referring to FIG. 4, a gaming system suitable for use in wager games and promotions of this disclosure is indicated generally by reference numeral (100). The gaming system (100) includes a central gaming server (102), and a number of portals (103*a*, 103*b*) in the form of portal websites on the World Wide Web of the Internet. In this embodiment, each one of the portal websites is an online casino website hosted on a corresponding casino web server (not shown). For convenience, embodiments of the invention will be described with particular reference to only two such online casino websites (103*a*, 103*b*). Other online casino websites may be present, or, alternatively, just one casino website may be present.

Each one of the online casino websites (103*a*, 103*b*) is accessible by a would-be player (not shown) through a player gaming workstation (104) in the form of an Internet-enabled computer workstation (e.g., general purpose computer) having a display monitor (105) and an associated pointing device (105*a*) such as a mouse or, alternatively, a touchpad. In this embodiment, online casino website (103*a*) is shown as having one computer workstation (104) logically connected thereto, whereas casino website (103*b*) is shown as being logically connected to two computer workstations (104). It will be appreciated by those skilled in the art that such online casino websites (103*a*, 103*b*) can be logically connected to any desired number of such computer workstations (104) simultaneously, which number is physically limited only by considerations of processing power and Internet access bandwidth.

The gaming server (102), the online casino web servers (not shown) corresponding to the online casino websites (103*a*, 103*b*), and the computer workstations (104) are capable of communicating with each other by means of an open communication network that is, in this embodiment, the Internet. The Internet is represented in FIG. 6 as separate logical communication networks (106, 107, 108, 110). The particular networking topology used and presence of intermediate networks or switching equipment is not important, and may make use of intervening communications network such as the public switched telephone network, cable networks, cellular wireless networks, WiFi, WiMax, etc.

Each online casino operates an account facility (114*a* and 114*b*, respectively) with a credit account corresponding to each player who participates in a game offered by the online casino. In the illustrated embodiment, therefore, the credit account facility (114*a*) has one player credit account associated with it, while credit account facility (114*b*) has two associated, but separate, player credit accounts.

A stored workstation program (not shown) is resident in the client computer workstation (104) which enables a participating player to browse a casino website and to interact with the gaming server (102) to play wager games such as slots, poker, Black Jack, Roulette and other games. The stored workstation program includes display tools for displaying on the user interface display (105): gaming symbols (e.g., slot machine reels, cards, Roulette wheels, etc.), gaming controls by which the player can place wagers, spin the reels, etc., and the results of play. The stored workstation program also includes gaming logic for facilitating the execution of a turn of a game, and communications facilities for communicating player actions using the user interface to the central gaming server, and receiving datagrams from the gaming server containing results of play. The data representing results of play is translated to graphical symbols which are presented on the user interface display (105). Further details of the conventional features are known in the art and described in the patent literature, see e.g., U.S. application Ser. No. 10/550,744 filed Sep. 23, 2005, published as US 2007/0060303.

Each computer workstation (104) may take the form of a conventional personal computer operating under a Windows XP, ME, 2000 or other operating system, which is well known and commercially available from Microsoft Corporation of Redmond, Wash., or other operating system such as provided by Apple Computer or a Linux operating system. The gaming workstation may also take the form of a portable computing device such as personal digital assistant or cellular telephone. The gaming workstation may also take the form of an electronic gaming terminal.

The gaming server (102) operates under control of a server-stored program (not shown) that co-operates with the stored workstation program in order to enable a player at the computer workstation (104) to play a wager game. The gaming server (102) operates, for example, under the Windows NT operating system.

The stored workstation program or application (not shown) and the corresponding stored server program will be referred to, for convenience, as a client process and a server process, respectively. The server process generates one or more random events that determine the outcome of turns of the game, such as determining the outcome of spins of the slot machine reels in the various slots games of the participating players. The client process of any particular computer workstation (104) obtains the result of the random events from the gaming server (102) along the communication network (108) and displays the outcome of the game on the display monitor (105) of the workstation in an intelligible manner, by causing the player's set of slots reels to spin and to come to rest at a position corresponding to the outcome. If a slot machine reel includes a progress symbol associated with an award of progress towards an expanded or stacked symbol, such as the star symbol of FIG. 3 or the "untamed Bengal Tiger" symbol (22) of FIG. 2, then an accumulation indicator (16) of the cluster (20) for the associated reel (12) becomes active. As noted, the instruction to activate the accumulation indicator (16) could come from the server (102) in the form of a flag or bit in the datagram with the results of the spin, or alternatively the workstation program may detect the presence of the relevant symbol in the datagram and activate the accumulation indicator (16).

The gaming server (102) thus generates results of spins of the reels for the workstations (104) and sends datagrams to the workstations indicating such results. In one possible embodiment, to generate the results of a spin of the reels, the gaming server (102) includes a memory (not shown, but conventional) storing data representing potential results for each of the reels. The gaming server uses a random process (e.g., random number generator) to select one of the results from memory. One of the results stored in the gaming server memory is data representing a result in the form of a symbol which is associated with progress towards an award of a stacked or expanded symbol, e.g., the star symbol of FIG. 3 or the "untamed Bengal Tiger" symbol (22) of FIG. 2. The memory may also store data representing a potential result that contains a deactivation symbol on a specific reel of the video slot game (e.g., the letter W or the word "Wild" with a line through it). Should the deactivation symbol be returned, an active accumulation indicator (16), if any exist at the time, associated with the reel is deactivated.

The gaming server can also "bank" the progress made towards an expanded or stacked symbol in the event that a player ceases playing the reel-type game, e.g., logs out of the casino or elects to play other games such as poker. The gaming server is further provided with a memory storing data (e.g., flags or bits) indicating, for each reel of the video slot game, whether any progress has been made towards an expanded or stacked symbol. The gaming server stores such data in the memory after the workstation has ceased play of the game. Should the player return to playing the reel-type game, the gaming server (102) consults the memory and returns a datagram to the player's workstation which includes such data. The player's workstation display then shows the accumulated or "banked" progress towards an expanded or stacked symbol on each reel of the video slot game (e.g., activation of the respective accumulation indicators that were previously activated) and starts play where they previously left off.

In order to play the games from any particular computer workstation (104), the client process (not shown) must first be downloaded to that computer workstation from the gaming server (102) or, alternatively, from a separate web server (not shown), and then installed on the workstation.

In use, a player wishing to participate in a wager game uses a computer workstation (104) to access an online casino website (103*a*, 103*b*) of his choice. When the player navigates using a Web browser to a home page of a casino, a promotional message may be displayed (described below). The player is presented with an icon on the GUI on his computer workstation (104), which the player can activate in order to download the client process and register with the casino operator. Following these tasks, the player may request to play games provided on the casino website by clicking on an appropriate icon or taking other similar action.

The online casino websites (103*a*, 103*b*) may be provisioned as a virtual slots room where slots is the only game available to would-be players, rather than one where a variety of different games are offered to a player.

It will be noted again that a system implementing the methods of this invention need not include two (or more) separate casino websites (103*a*, 103*b*), and that only one website (103) may be linked to the gaming server (102).

The following clauses are offered as further descriptions of the disclosed inventions.

1. A machine configured to enable a player to play a reel-type wager game using the machine, comprising:

a display configured to display two or more reels of a reel-type wager game;

a memory storing software instructions for facilitating a user to play the reel-type wager game; and a processor for executing the software instructions;

wherein the software comprises instructions for displaying a result of a spin of such reels in the form of a progress symbol (22) associated with progress towards an award of an expanded or stacked symbol, said progress symbol causing an activation of an accumulation indicator (16) provided on the display providing a display of the progress towards meeting a trigger condition for the award of the expanded or stacked symbol (24) in the respective reel over multiple spins of the reel-type game.

2. The machine of clause 1, wherein the display displays a set of accumulation indicators for each of the two or more reels.

3. The machine of clause 1 or clause 2, wherein the stacked or expanded symbol comprises a WILD symbol.

4. The machine of any of clauses 1-3, wherein the reel-type game comprises a slots game featuring an array of five reels in a 3×5 array of symbols and having a multitude of pay lines, each of the five reels having an associated set of accumulation indicators.

5. The machine of clause 4, wherein the activation of the accumulation indicators for each reel in the array of reels occurs independently of results occurring on other reels in the array of reels.

6. The machine of clause 4 or clause 5, wherein the processing instructions display an expanded or stacked WILD symbol for a given reel upon activation of all the accumulation indicators in the set of accumulation indicators for the said given reel as a result of a turn of the game.

7. The machine of clause 6, wherein for successive subsequent turns of the game the accumulation indicators for said given reel are progressively deactivated.

8. The machine of any of clauses 4-7, wherein the processing instructions display an expanded or stacked WILD symbol for a given reel upon activation of a subset of the accumulation indicators in the set for the said given reel as a result of a turn of the game.

9. The machine of any of clauses 1-8, wherein the accumulation indicator for a reel only becomes active when the progress symbol occurs on a center pay line position of the reel.

10. The machine of any of clauses 1-9, wherein the reel-type game comprises a symbol set for each of the reels and wherein one of the symbols in the symbol set comprises a deactivation symbol, and wherein if the deactivation symbol appears on the reel as a result of a spin of the reel-type game then an active accumulation indicator for said reel is then deactivated.

11. The machine of any of clauses 1-10, wherein the reel-type game comprises a symbol set for each of the reels and wherein the progress symbol causing activation of the accumulation indicator comprises one of the symbols in the symbol set.

12. The machine of clause 11, wherein the progress symbol comprises a WILD symbol.

13. A server (102) communicating with a machine having a display enabling a player to play a reel-type game having two or more reels over a computer network, the server comprising a processing unit randomly generating results of a spin of each of a plurality of reels in the reel-type game for the machine and transmitting such results to the machine as a datagram over the computer network, wherein the datagram generated by the server includes a data element indicating that one of the results of a spin of such plurality of reels is in the form of a progress symbol (22) associated with progress towards an award of an expanded or stacked symbol (24) appearing in the display, the datagram causing an activation of an accumulation indicator (16) on the machine display providing a display of the progress towards meeting a trigger conditions for the award of the expanded or stacked symbol.

14. The server of clause 13, wherein the data element comprises a flag or bit.

15. The server of clause 13, wherein the data element comprises data indicating the symbols to be presented on the display of the machine as a result of the spin of the reels.

16. The server of any of clauses 13-15, wherein the server further comprises a memory storing data representing potential results for each of the reels and the processing unit executes a random process to select one of the results from memory.

17. The server of any of clauses 13-16, wherein the server further generates a datagram for the machine containing a data element associated with a deactivation of the accumulation indicator.

18. The server of any of clauses 13-17, wherein the server further comprises a memory storing the progress made towards an expanded or stacked symbol in the event that a player ceases playing the reel-type game on the machine.

19. The server of any clauses 13-18, wherein the machine comprises a remote computer and the computer network comprises the Internet.

20. The server of any of clauses 13-19, wherein the machine comprises a video gaming terminal and wherein the computer network comprises a local area network.

21. The server of any of clauses 13-20, wherein the stacked or expanded symbol comprises a WILD symbol.

22. The server of any of clauses 13-21, wherein the progress symbol comprises a symbol in a symbol set for the game.

23. The server of any of clauses 13-22, wherein the progress symbol comprises a WILD symbol.

24. A method of playing a reel-type game using a machine having a display, comprising the steps of:

providing on the display a plurality of reels (12); and displaying a result of a spin of such reels in the form of a progress symbol (22) associated with an award of progress towards an award of an expanded or stacked symbol (24), the progress symbol causing an activation of an accumulation indicator (16) provided on the display providing a display of the progress towards meeting a trigger condition for the award of the expanded or stacked symbol in the respective reel over multiple spins of the reel-type game.

25. The method of clause 24, wherein the display displays a set of accumulation indicators for each of the plurality of reels.

26. The method of clause 24 or clause 25, wherein the stacked or expanded symbol comprises a WILD symbol.

27. The method of any of clauses 24-26, wherein the reel-type game comprises a slots game featuring an array of five reels in a 3×5 array of symbols and having a multitude of pay lines, each of the five reels having an associated set of accumulation indicators.

28. The method of clause 27, wherein the activation of the accumulation indicators for each reel in the array of reels occurs independently of results occurring on other reels in the of the array of reels.

29. The method of clause 27, wherein the method further comprises the step of displaying an expanded or stacked WILD symbol for a given reel upon activation of all the accumulation indicators in the set of accumulation indicators for the said given reel as a result of a turn of the game.

30. The method of clause 29, further comprising the step of progressively deactivating the accumulation indicators after successive subsequent turns of the game.

31. The method of clause 25, further comprising the step of displaying an expanded or stacked WILD symbol for a given reel upon activation of a subset of the accumulation indicators in the set for the said given reel as a result of a turn of the game.

32. The method of any of clauses 24-31, wherein the accumulation indicator for a reel only becomes active when the progress symbol occurs on a center pay line position of the reel.

33. The method of any of clauses 24-32, wherein the reel-type game comprises a symbol set for each of the reels and wherein one of the symbols in the symbol set comprises a deactivation symbol, and wherein the method further comprises the step of deactivating an active accumulation indicator for a given reel if the deactivation symbol appears on the given reel as a result of a spin of the reel-type game.

34. The method of any of clauses 24-33, wherein the reel-type game comprises a symbol set for each of the reels and wherein the progress symbol causing activation of the accumulation indicator comprises one of the symbols in the symbol set.

35. The method of any of clauses 24-34, wherein the progress symbol comprises a WILD symbol.

We claim:

1. A gaming machine, comprising:

a display device configured to display two or more reels including a first reel of a reel-type game and configured to display a first set of accumulation indicators associated with the first reel;

a memory storing software for controlling the display device displaying the reels; and a processor for executing the software;

wherein the software comprises instructions for displaying a progress symbol on the first reel as a result of spinning the reels, wherein displaying the progress symbol on the first reel is associated with activating an accumulation indicator of the first set of accumulation indicators on the display device so as to indicate, over multiple spins of the reel-type game, a progress towards meeting a trigger condition for an award of an expanded or stacked symbol on the first reel, and wherein the display device displays, for a turn of the game during which all accumulation indicators of the first set of accumulation indicators associated with the first reel are active, the expanded or stacked symbol only on the first reel.

2. The machine of claim 1, wherein the machine is configured to display a respective set of accumulation indicators for each reel of the two or more reels.

3. The machine of claim 1, wherein the expanded or stacked symbol comprises a WILD symbol.

4. The machine of claim 1, wherein the machine is configured to display an array of five reels in a 3×5 array of symbols having a multitude of pay lines, each of the five reels having an associated set of accumulation indicators.

5. The machine of claim 4, wherein activation of the accumulation indicators for each reel in the array of reels occurs independently of results occurring on other reels in the array of reels.

6. The machine of claim 4, wherein the instructions are executable to cause the display device to display an expanded or stacked WILD symbol for the first reel upon activation of all accumulation indicators of the first set of accumulation indicators associated with the first reel as a result of a given turn of the game.

7. The machine of claim 1, wherein for successive turns of the game, subsequent the turn of the game during which all accumulation indicators of the first set of accumulation indicators associated with the first reel are active, one of the active accumulation indicators in the first set of accumulation indicators is deactivated, and wherein all accumulation indicators of the first set of accumulation indicators are deactivated prior to reactivating any of the accumulation indicators of the first set of accumulation indicators after the turn of the game.

8. The machine of claim 1, wherein the reel-type game comprises a symbol set for each of the reels, wherein one of the symbols in the symbol set for each of the reels comprises a deactivation symbol, and wherein the machine is configured to deactivate an active accumulation indicator for a reel if the deactivation symbol appears on the reel as a result of a spin of the reel-type game.

9. The machine of claim 1, wherein the reel-type game comprises a symbol set for each of the reels, and wherein the progress symbol comprises one of the symbols in the symbol set for the first reel.

10. A server configured to communicate with a machine that has a display and that enables a player to play a reel-type game having two or more reels including a first reel over a computer network, the server comprising:

a processing unit configured to randomly generate results of a spin of each reel of the two or more reels in the reel-type game for the machine and to transmit the results to the machine as a datagram over the computer network, wherein a first datagram transmitted by the server includes a data element indicating that one of the results of a spin of the first reel is in the form of a progress symbol associated with progress towards an award of an expanded or stacked symbol appearing in the display on the first reel, wherein the first datagram causes an activation of an accumulation indicator on the machine display to indicate, over multiple spins of the reel-type game, the progress towards meeting a trigger condition for the award of the expanded or stacked symbol on the first reel, wherein a second datagram transmitted by the server includes a data element indicating that a result of spinning the first reel for a turn of the game is in the form of a progress symbol on the first reel and a flag or bit that indicates another indicator of the first set of accumulation indicators associated with the first reel is to become active, and wherein the second datagram causes an activation of the other accumulation indicator of the first set of accumulation indicators associated with the first reel such that the machine displays, for the turn of the game, all accumulation indicators associated with the first reel as being active and the expanded or stacked symbol only on the first reel.

11. The server of claim 10, wherein the data element comprises a flag or bit.

12. The server of claim 10, wherein the data element comprises data indicating symbols to be presented on the display of the machine as a result of the spin of the two or more reels.

13. The server of claim 10, wherein the server further comprises:

a memory storing data representing potential results for each of the reels, wherein the processing unit executes a random process to select one of the potential results from the memory.

14. The server of claim 10, wherein the server is configured to generate, for the machine, a datagram containing a data element associated with a deactivation of the accumulation indicator.

15. The server of claim 10, wherein the server further comprises:

a memory storing data indicating the progress towards meeting the trigger condition for the award of the expanded or stacked symbol on the first reel in the event that a player ceases playing the reel-type game on the machine.

16. The server of claim 10, wherein the machine comprises a remote computer and the computer network comprises the Internet.

17. The server of claim 10, wherein the machine comprises a video gaming terminal and wherein the computer network comprises a local area network.

18. A method of playing a reel-type game using a machine having a display device, the method comprising:

providing on the display device a plurality of reels, wherein the plurality of reels includes a first reel;

providing on the display device a first set of accumulation indicators associated with the first reel;

displaying, on the first reel, a progress symbol on the first reel as a result of spinning the plurality of reels;

in response to displaying the progress symbol, causing an activation of an accumulation indicator of the first set of accumulation indicators on the display device to indicate, over multiple spins of the reel-type game, a progress towards meeting a trigger condition for an award of an expanded or stacked symbol on the first reel; and displaying, for a turn of the game during which all accumulation indicators of the first set of accumulation indicators associated with the first reel are active, the expanded or stacked symbol only on the first reel.

19. The method of claim 18, further comprising:

displaying, using the display device, a set of accumulation indicators for each reel of the plurality of reels.

20. The method of claim 18, wherein the expanded or stacked symbol comprises a WILD symbol.

21. The method of claim 18, wherein the reel-type game comprises a slots game featuring an array of five reels in a 3×5 array of symbols and having a multitude of pay lines, each of the five reels having an associated set of accumulation indicators.

22. The method of claim 19, further comprising: displaying an expanded or stacked WILD symbol for a given reel of the plurality of reels upon activation of all accumulation indicators in the set of accumulation indicators for the given reel as a result of a given turn of the game.

23. The method of claim 22, further comprising:

progressively deactivating the accumulation indicators for the given reel after successive turns of the game subsequent the given turn of the game.

24. The method of claim 19, further comprising:

displaying an expanded or stacked WILD symbol for a given reel of the plurality of reels upon activation of a subset of accumulation indicators in the set of accumulation indicators for the given reel as a result of a turn of the game.

25. The method of claim 18, wherein the first set of accumulation indicators associated with the first reel only becomes active when the progress symbol occurs on a center pay line position of the first reel.

26. The method of claim 18, wherein the reel-type game comprises a symbol set for each of the reels, wherein one of the symbols in the symbol set for a given reel of the reels comprises a deactivation symbol, and wherein the method further comprises:

deactivating an active accumulation indicator for the given reel if the deactivation symbol appears on the given reel as a result of a spin of the reel-type game.

27. The method of claim 18, wherein the progress symbol comprises a WILD symbol.

28. The machine of claim 7, wherein accumulation of activated indicators on the display device to show progress towards a next occurrence of meeting the trigger condition for the award of the expanded or stacked symbol on the first reel does not occur until after all the accumulation indicators for the first reel are progressively deactivated.

29. The machine of claim 6, wherein the expanded or stacked WILD symbol does not persist beyond the given turn of the game.

30. The machine of claim 1, wherein the reel-type game comprises a reel-type wager game.

* * * * *